US005767513A

United States Patent [19]

Dressler et al.

[11] Patent Number: 5,767,513

[45] Date of Patent: Jun. 16, 1998

[54] HIGH TEMPERATURE OCTOPOLE ION GUIDE WITH COAXIALLY HEATED RODS

[75] Inventors: Rainer A. Dressler, Arlington; Dale J. Levandier, Westford, both of Mass.

[73] Assignee: The United States of America as represented by the Secretary of the Air Force, Washington, D.C.

[21] Appl. No.: 829,418

[22] Filed: Mar. 31, 1997

[51] Int. Cl.[6] ..... H01J 49/42

[52] U.S. Cl. ..... 250/292; 250/290

[58] Field of Search ..... 250/292, 290, 250/281, 282

[56] References Cited

U.S. PATENT DOCUMENTS 4,234,791 11/1980 Enke et al. ..... 250/281
4,555,666 11/1985 Martin ..... 326/233
4,975,576 12/1990 Federer et al. ..... 250/282
5,381,007 1/1995 Kelley ..... 250/282
5,436,445 7/1995 Kelley et al. ..... 250/282
5,459,315 10/1995 Aaki ..... 250/292
5,561,291 10/1996 Kelley et al. ..... 250/282
5,578,821 11/1996 Meisberger et al. ..... 250/310

*Primary Examiner*—Kiet T. Nguyen
*Attorney, Agent, or Firm*—Robert L. Nathans

[57] ABSTRACT

A high-temperature octopole/collision apparatus features coaxially heated rf emitting octopole rods coacting with a collision oven cell. The rods are maintained at a slightly higher temperature than the oven cell to prevent condensation of the sample on the poles and to ensure a well characterized operating temperature necessary for absolute cross-section measurements.

20 Claims, 4 Drawing Sheets

HIGH TEMPERATURE OCTOPOLE ION GUIDE WITH COAXIALLY HEATED RODS

STATEMENT OF GOVERNMENT INTEREST

The present invention may be made by or for the Government for governmental purposes without the payment of any royalty thereon.

BACKGROUND OF THE INVENTION

The present invention relates to tools for determining the energy dependence and absolute integral cross sections of chemical reactions occurring in collisions between ions and high-temperature vapors.

Gas-phase ion-molecule/atom collisions play an important role in ionospheric chemistry, the environment of spacecraft and plasma processing. Accurate absolute integral reaction cross sections, which are determined experimentally, must be known in order to model these environments. Many of these environments involve hyperthermal collision energies, and the translational energy dependence of the cross sections therefore is also required. Cross section measurements at higher kinetic energies are difficult because the velocity distributions of primary and secondary ions can be very different, leading to potential ion collection discrimination. The generally accepted technique in overcoming discrimination problems is the guided-ion beam technique. See E. Teloy et al., "Integral cross sections for Ion-molecule Reactions. I. The Guided Beam Technique", Chem. Phys. 4, 417(1974) . In a guided-ion beam experiment, ion-neutral collisions occur within the confining fields of a radio-frequency (rf) multipole in a high vacuum apparatus. In most cases an octopole is used, consisting of eight parallel rods in a circular array, on which opposite phases of a rf voltage are applied to adjacent poles. Ions are collected irrespective of scattering angles, thus allowing absolute integral cross sections to be determined. This technique has proven to yield accurate cross sections from near-thermal collision energies to hyperthermal energies exceeding 50 eV.

The guided-ion beam technique relies on introducing the vapor of a target material into a collision cell through which the rf multipole guides the ions. The target vapor density and effective interaction length must be measured in order to determine absolute reaction cross sections. The target gas density is normally measured using a capacitance manometer, which may be used only for a volatile sample. Most experiments to date have therefore involved target materials with sufficient vapor pressures at room temperature. Anderson and coworkers, see J. Chem. Phys. 99, p. 3468 (1993), have constructed a guided-ion beam experiment in which a non-volatile sample is heated in an oven collision cell. Absolute cross sections, however, were not obtained, because the exact density of the target material could not be determined due to the fact that the temperature of the octopole rods was not measured and was lower than that of the cell. Since a capacitance manometer cannot be used, an absolute measurement relies on deducing the target density from an accurate measurement of the coldest temperature to which the target vapor is exposed in the cell. Alternatively, as described below, the vapor density may be measured directly using optical methods.

Sunderlin and Armentrout (Chem. Phys. Lett. 167, P. 88, 1990) have carried out an experiment where both collision cell and rod supports are either heated or cooled with a circulated fluid. The experiment was primarily used to obtain absolute integral cross sections at colder than thermal temperatures, and is limited in the high temperature range due to the lack of high-temperature, non-conducting fluids. The experiment also relies on temperature equilibration of the collision cell, rod supports and rods. No measurements have been reported in which non-volatile samples were investigated.

BRIEF SUMMARY OF THE INVENTION

The present invention employs a novel approach to measuring ion-molecule/atom reaction cross sections at high temperatures in which the nominal temperature of the experiment is well characterized. The preferred embodiment of the invention utilizes thermo-coax heaters as radio frequency (rf) octopole rods which can then be directly heated to a specified temperature such as up to about 1100 K without affecting the requirement of applying the rf voltage to the rods. Provided the rod temperature is higher than that of the oven cell, the target vapor pressure is governed by the cell temperature which is readily determined. The higher octopole rod temperature also prevents condensation of target material on the pole surfaces, which would deteriorate the ion-optical performance of the ion guide. The ion beam apparatus is also configured in a way to allow optical absorption measurements through the collision cell for target gas density determination, in cases where measurements are conducted with atomic vapors that exhibit strong optical transitions. The desired density measurement is then related to and can be determined from the observed absorption of a continuum light source. The invention ensures a well characterized operating temperature necessary for absolute cross-section measurements including ion-molecule reactions involving nonvolatile target species including metals.

BRIEF SUMMARY OF THE DRAWINGS

Other features and advantages of the invention will become more apparent upon study of the following description, taken in conjunction with the drawings in which.

DETAILED DESCRIPTION OF PREFERRED EMBODIMENTS OF THE INVENTION

Figure 1:
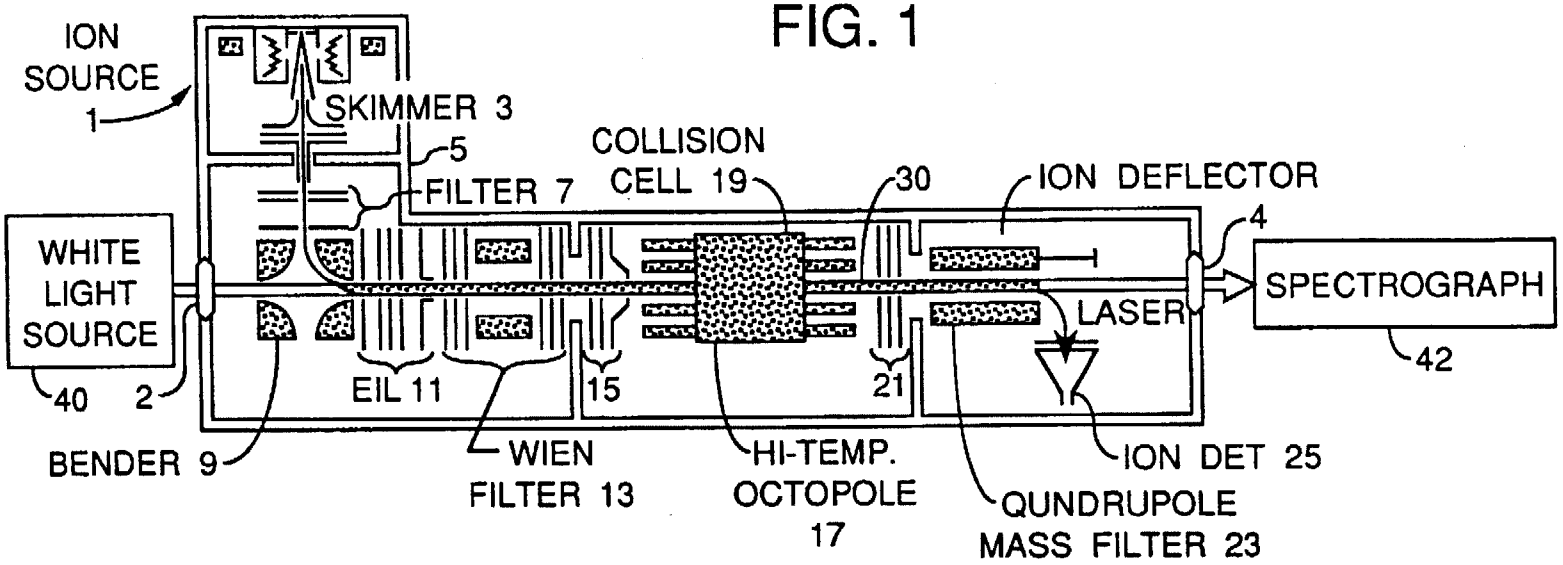
FIG. 1 shows a brief schematic overview of the high-temperature guided-ion beam high vacuum apparatus constructed and tested by the inventors.

FIG. 1 depicts a schematic overview of the high-temperature guided-ion beam high vacuum apparatus which we have constructed and tested. An ion beam is generated under vacuum in a traditional electron impact ion source 1. Ions may be formed by electron impact of a precursor gas as it emanates from either a continuous effusive nozzle or a pulsed supersonic jet. The ion beam passes through a skimmer/lens assembly 3 into a second differentially pumped chamber 5. Following passage through another ion lens 7 the ion beam is turned 90° using a DC quadrupole bender 9. The beam then passes through a third ion lens 11 before being accelerated into a Wien velocity filter (Colutron Research Corp.) for mass selection 13. The mass-selected ions are then decelerated using a deceleration lens and passed via an injection lens assembly 15 into our novel high-temperature octopole assembly 17 of the present invention. The octopole guides the ions through a tantalum oven collision cell 19 maintained at a first elevated temperature of up to about 1100degrees K by heater means 20. Primary and secondary ions, produced in collisions between primary ions and oven-cell vapor, are extracted from the octopole with an extraction lens 21 and enter a quadrupole mass filter 23 for mass analysis before being detected with an off-axis microchannel plate (Galileo) ion detector 25. Windows 2 and 4, positioned at opposite ends of the vacuum chambers, allow the determination of the vapor density using absorption measurements along the octopole ion guide axis 30, in a manner to be described. The apparatus without the 900 bender 9 and equipped with a conventional octopole assembly has been described in our prior paper. See R. A. Dressier et al., J. Chem. Phys. 99, 1159(1993).

Figure 2:
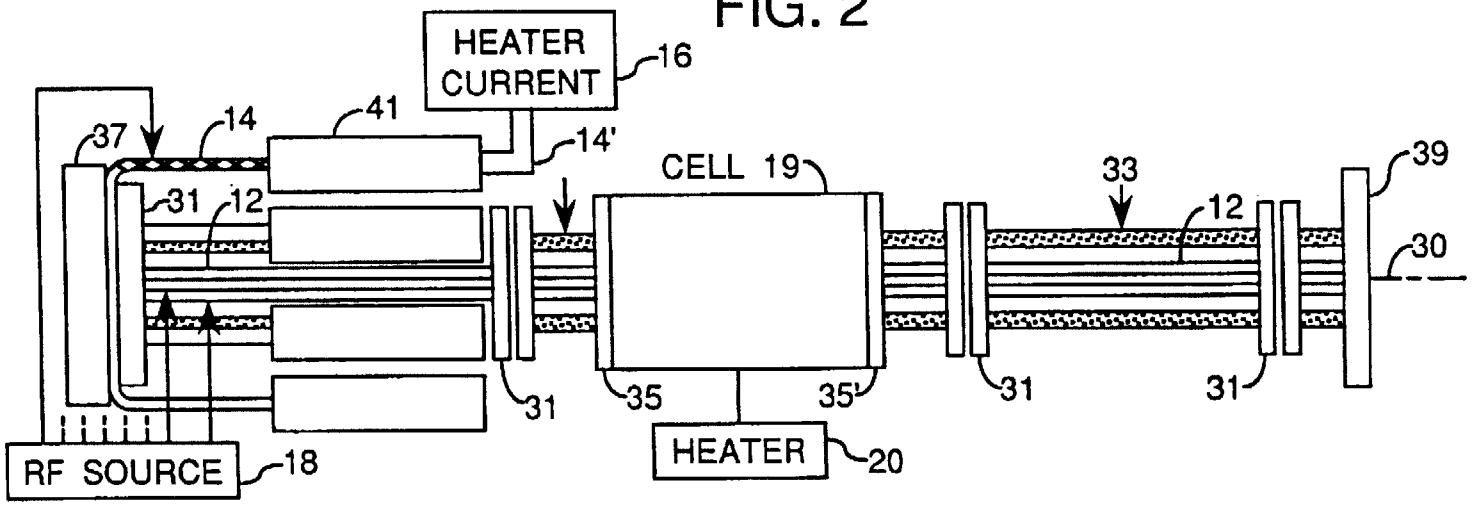
FIG. 2 illustrates the novel high temperature octopole assembly incorporating the invention.

FIG. 2 illustrates our novel high temperature octopole assembly 17 of FIG. 1, which permits easy installation and removal from the vacuum chamber. An rf potential is applied to each pole 12 of the eight pole circular array of poles for the aforesaid purpose of guiding ions through the collision cell in the conventional manner. The pole array comprises eight hollow rods or tube-like elongated metallic members 12 positioned along and surrounding the ion beam guide axis 30, and most preferably consists of a metallic tubular "biax" heater (ARi Industries, Aerorod BXX Heater), eight of which are bent in the form of a "U" and arranged in a circular array of poles or rods 12, parallel with, and surrounding the longitudinal axis of the assembly, as shown in FIG. 2. The "biax" heater design features a twin pair of nickel-chrome-iron heater wires 14 packed in MgO packing material and encased in an Inconel 600 metallic sheath comprising each pole 12, from which the heater wire is electrically isolated by the packing material. The twin conductors 14 minimize the magnetic field generated by the heater current, while the heater wires-heath isolation allows rf to be applied to the heater sheath by RF source 18, without interference from the power applied to the heater wires by heater wire current source 16 via input leads 14'. Thus, these components constitute multiple rod heater means for maintaining the rods 12 at a second elevated temperature, preferably slightly greater than the first elevated temperature of the oven cell 19. The dimensions of the circular pole array must be kept as small as possible to minimize target vapor leakage from the oven cell, and to assure complete collection of all ions exiting the octopole.

Structural support for the collision oven cell 19 and for the circular pole holders 31 is provided by four tantalum support rods 33 attached to either cell end plate 35 an 35', and to the injector 37 and extractor 39 endpieces, as indicated in FIG. 2. Eight enlarged hollow cylindrical end pieces 41 are attached to eight associated poles 12 to accommodate the junctions of the thick heater current supply leads 14' and the tiny heater wires 14 within the poles 12.

Figure 3:
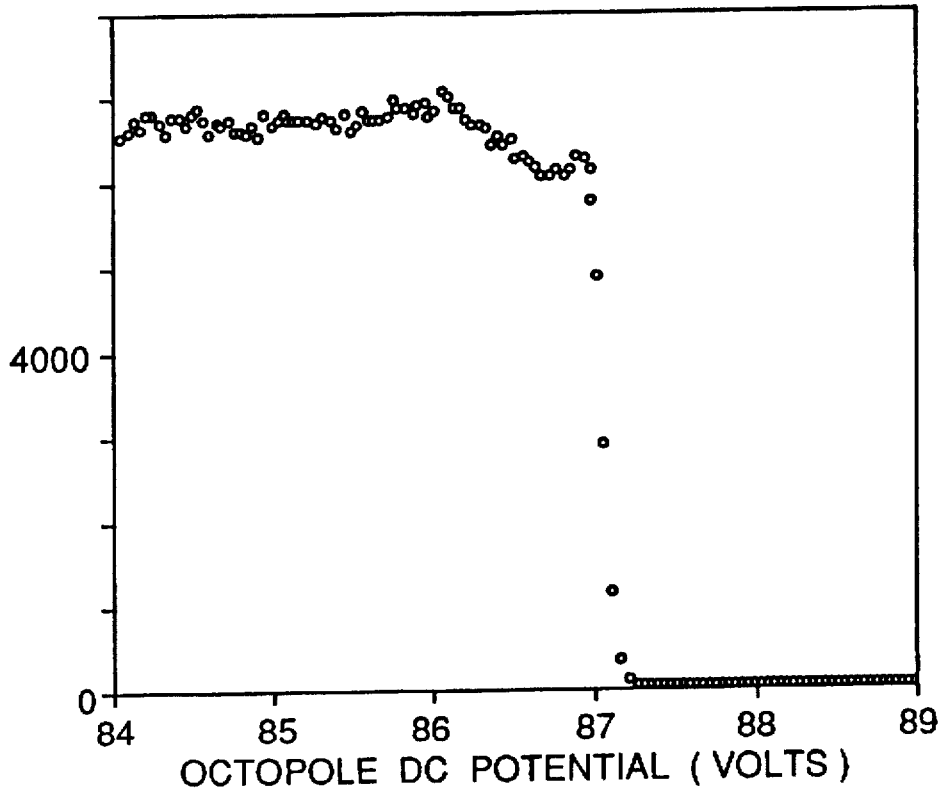
FIG. 3 shows a plot of ion current v. octopole DC bias potential.
Figure 4:
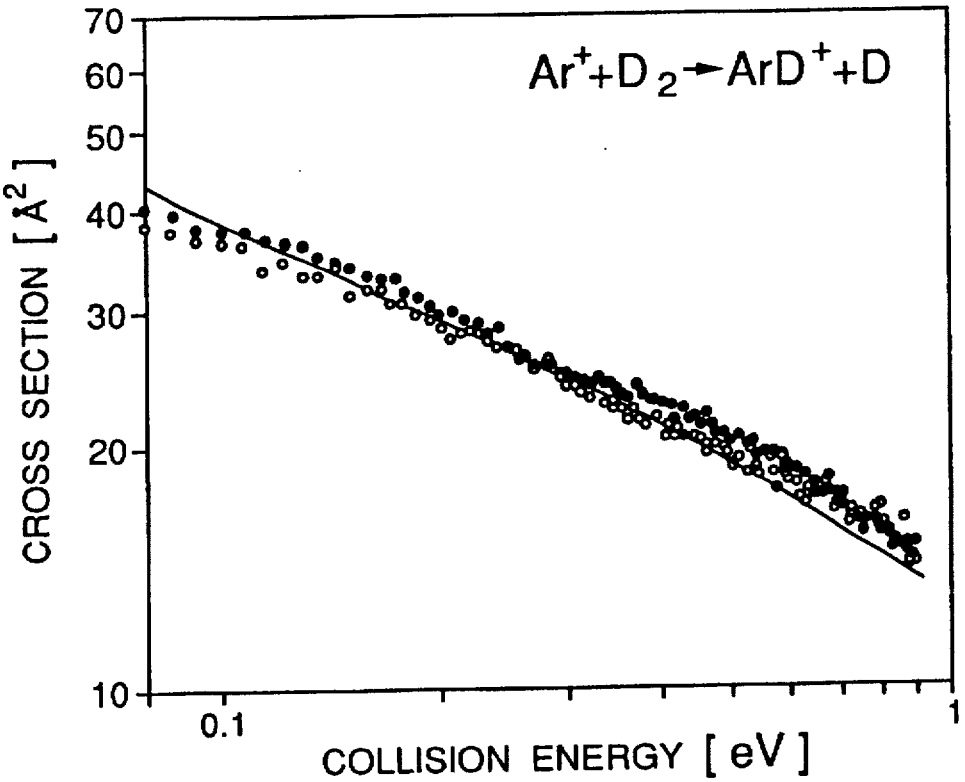
FIGS. 4 and 5 show reaction cross sections for reactions (1) and (2) respectively, that are set forth in the specification.

The proper operation of the ion optical properties of the guided-ion beam experiment has been verified at thermal and elevated temperatures. The ion energy resolution can be examined by conducting octopole DC potential retardation scans. An example of transmitted $Ar^+$ ion current as a function of octopole DC potential, at 619 K, is shown in FIG. 3. A sharp cutoff is observed at 87.075 V, corresponding to the ion formation potential. At this potential, ions in the octopole have near-zero kinetic energy. The width of the sharp fall-off region observed in the figure represents the energy resolution, which in this case is approximately 120 meV full width at half maximum. The good resolution is an indication that the rf potential does not affect the kinetic energy of the ions and that an appropriate frequency for this particular mass has been chosen. The effective path length of the high-temperature octopole collision cell is calibrated by measuring the production yield from the well-known ion-molecule reaction:

$$Ar^+ + D_2 \rightarrow ArD^+ + D \quad (1)$$

for which cross sections as a function of collision energy have been reported by Ervin and Armentrout in J. Chem. Phys. 83, 166 (1985). In Reaction (1), primary and secondary ions have very similar velocities, making accurate integral cross section measurements possible with numerous methods. Cross section measurements using the present instrument at thermal temperatures are shown in FIG. 4. The data are compared with the measurements of Ervin and Armentrout. An effective collision cell length of 2.66 cm yielded the best agreement between the two data sets. This corresponds to 50% of the actual collision cell length. FIG. 4 indicates the reaction cross section for reaction (1) as a function of relative collision energy. The solid curve is taken from the last named reference. The open circles were measured at room temperature (294 K) in the present apparatus, and were scaled to the earlier data to determine the effective interaction length of the high temperature collision cell. The filled circles represent the cross section for reaction (1) measured at 619 K. This cross section confirms both the proper octopole operation at high temperature, and the cell temperature measurement. That is, since the capacitance manometer used to measure the $D_2$ pressure is at room temperature for both the low and high temperature cross section measurements, the actual density at high temperature must be corrected by accepted methods. See the Sunderlin reference cited above. The resulting cross section is in excellent agreement with the low temperature experiment.

High-temperature measurements of non-volatile samples are conducted by running the primary beam through the octopole and monitoring product ion formation, while the oven cell and poles are heated. The power vs. temperature dependence of the pole heating was determined separately using thermocouples spotwelded onto the pole surfaces. The octopole rods are always heated to a temperature that is slightly higher than that of the oven to limit condensation of the sample onto the poles.

The target vapor density for nonvolatile samples is determined from the collision cell temperature and, if possible, from optical absorption measurements, facilitated by windows 2 and 4 of FIG. 1. The collision cell temperature is measured using thermocouples attached to the collision cell end pieces. In the optical measurements, the cell transmission of white light emitted by a halogen-tungsten lamp constituting a white light source 40 in FIG. 1, is measured in the spectral region of a strong atomic absorption line of known oscillator strength. A liquid-nitrogen cooled CCD detector (Princeton Instruments) and 0.18 m spectrograph 42 are used for the light detection via window 4. The density is derived from curve-of-growth calculations, in which the Voigt absorption profile is integrated over the observed spectral range.

Figure 5:
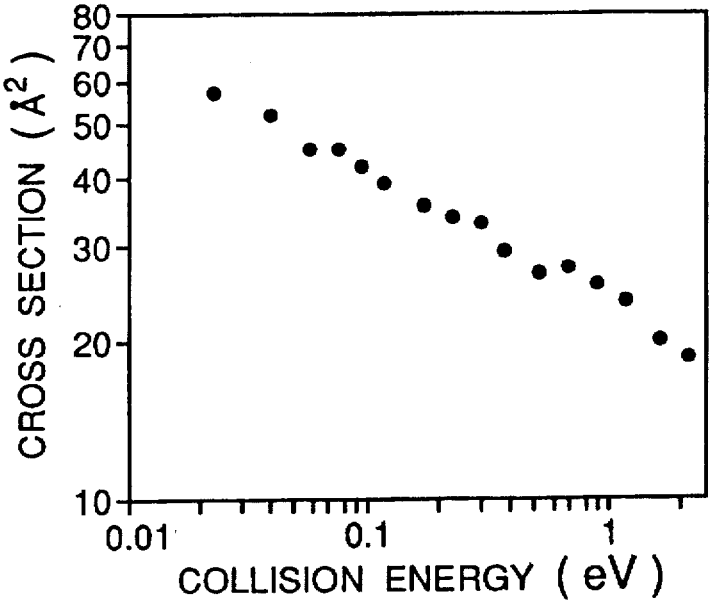
Figure 6:
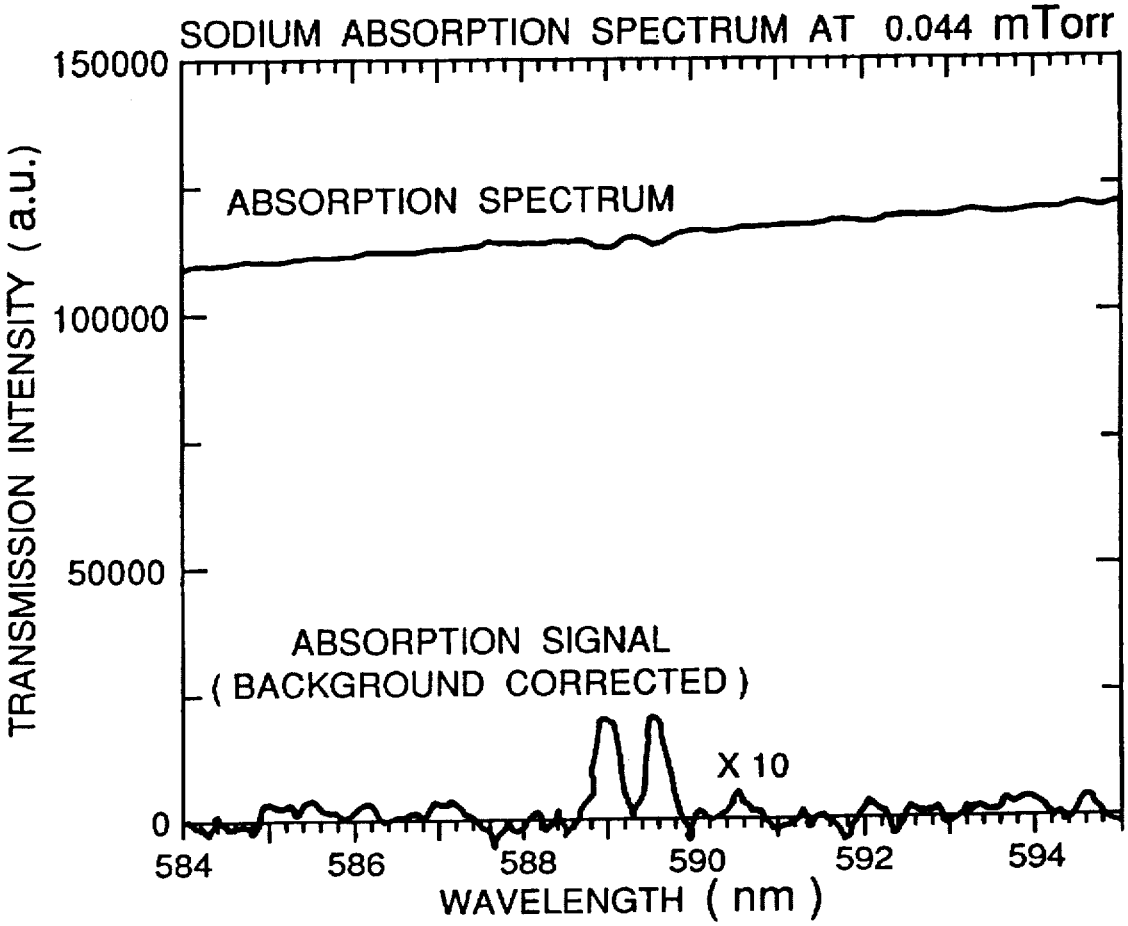
FIG. 6 shows a sodium absorption spectrum and the related inverted absorption signal.
Figure 7:
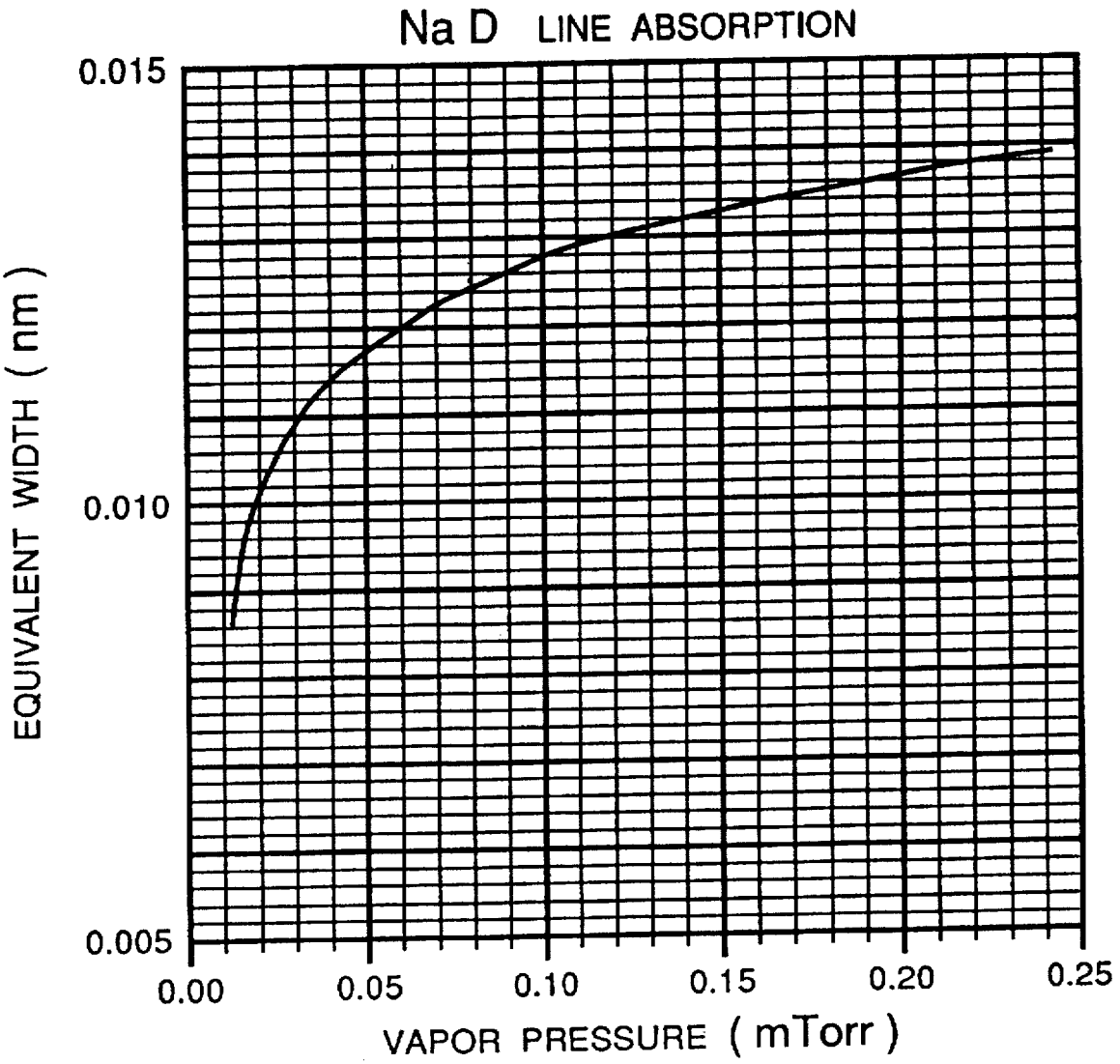
FIG. 7 shows a growth of sodium D line absorption calculated for the vapor pressure range of interest.

FIG. 5 indicates the absolute cross section for the charge transfer reaction:

$$N_2^+ + Na \rightarrow N_2 + Na^+ \quad (2)$$

measured in the present apparatus with the collision cell at a temperature of 430 K. In this experiment, the cell was heated via radiative heating by the poles, instead of heating the cell directly. The pressure of the sodium vapor, 0.0440 mTorr, was determined optically by measuring the absorption spectrum of the vapor in the region of the sodium D line, which is shown in FIG. 6, and which indicates the sodium absorption spectrum (top curve). The bottom curve is the inverted absorption signal obtained after subtracting the unscattered light levels from the absorption spectrum. The two bands represent the sodium D line fine structure. Integration of the observed absorption signal, taking into account the Na ground state hyperfine structure, allows the vapor density or pressure to be recovered from the curve-of-growth for this system, plotted in FIG. 7 for the pressure range typically required in the guided-ion beam experiment. This plot indicates that the sodium D line absorption measurement is more satisfactory at the lower extreme of this pressure region, where the current work was carried out.

In this experiment, instead of heating the cell directly, with its biax heater, the cell was heated radiatively from the octopole rods. The cell temperature, as measured on the outside surface by thermocouple, was 430 K and was observed not to change in about 20 minutes prior to this measurement. The sodium vapor density was measured optically, and the temperature derived from that measurement, 450 K, is understandably slightly higher than the thermocouple measurement. FIG. 16 indicates the sodium absorption spectrum (top curve). The bottom curve is the inverted absorption signal obtained after subtracting the unscattered light levels from the absorption spectrum. The two bands represent the sodium D line fine structure.

This invention represents the first high-temperature octopole system that can exceed target vapor temperatures of 200° C. This makes guided-ion beam experiments accessible to studying the reactivity of non-volatile samples, in particular ion-metal atom reactions which play an important role in the upper atmosphere. Thus, an entirely new class of chemical reactions can be investigated. The principal new feature enabling well-characterized quantitative measurements is the heating of both the oven cell and the octopole rods.

In summary, the invention preferably employs coax sheath heaters as octopole rods that maintain the necessary small diameters of the rods while not affecting the rf propagation, which occurs primarily on the rod surfaces (skin effect). A further new feature of the invention is the experimental configuration allowing optical absorption measurement for target gas density determination. Although this configuration has been routinely used for octopole laser-probing of ions, it has never been used for probing target neutral species.

In addition to cell absorption measurements, ion-neutral collision luminescence can be detected with the current experimental apparatus. In this mode, the light emitted along the main axis of the experiment is observed with the same optical detection system described above for the absorption measurement. The relatively small solid angle of light collection limits this method to observing atomic emissions. The analysis of a luminescence spectrum can yield information about the state-to-state dynamics of ion-molecule reactions as well as provide clues to the origin of metal-ion emissions observed in the atmospheric night glow.

Further details of the present invention may be obtained from our paper published in Review of Scientific Instruments, 68 (1), January 1997, and incorporated by reference herein.

While the described embodiment of the invention is at present preferred, other embodiments will occur to those skilled in the art and thus the scope of the invention is as defined by the terms of the following claims and art recognized equivalents thereof

What is claimed is:

1. A high temperature multipole ion guide, enabling measurement of absolute cross-sections of ion-metal atom reactions within a high temperature collision cell comprising:

(a) a collision cell, positioned along an ion guide axis, having means for maintaining said collision cell at a first elevated temperature;

(b) a radio frequency multipole assembly having a plurality of rods for carrying radio frequency energy thereon and positioned along said ion guide axis for guiding ions through said collision cell; and (c) multipole rod heater means for maintaining said plurality of rods at a second elevated temperature higher than said first elevated temperature.

2. The apparatus of claim 1 wherein said multipole assembly comprises eight rods surrounding said ion guide axis.

3. The apparatus of claim 2 wherein said plurality of rods contain twin current bearing heater wires extending along the lengths of said rods for maintaining said rods at said second elevated temperature while minimizing magnetic fields generated by heater wire current.

4. The apparatus of claim 3 wherein said plurality of rods are hollow and contain packing material therein surrounding said heater wires, to electrically isolate said wires from outer portions of said rods.

5. The apparatus of claim 3 further including means for providing absorption measurements of vapors exhibiting strong optical transitions by projecting light beams along said ion guide axis.

6. The apparatus of claim 2 further including means for providing absorption measurements of vapors exhibiting strong optical transitions by projecting light beams along said ion guide axis.

7. The apparatus of claim 1 wherein said plurality of rods contain twin current bearing heater wires extending along the lengths of said rods for maintaining said rods at said second elevated temperature while minimizing magnetic fields generated by heater wire current.

8. The apparatus of claim 7 wherein said plurality of rods are hollow and contain packing material therein surrounding said heater wires, to electrically isolate said wires from outer portions of said rods.

9. The apparatus of claim 8 further including means for providing absorption measurements of vapors exhibiting strong optical transitions by projecting light beams along said ion guide axis.

10. The apparatus of claim 1 further including means for providing absorption measurements of vapors exhibiting strong optical transitions by projecting light beams along said ion guide axis.

11. A high temperature multipole ion guide enabling measurement of absolute cross-sections of ion-metal atom reactions within a high temperature collision cell comprising:

(a) a collision cell, positioned along an ion guide axis, having means for maintaining said collision cell at a first elevated temperature of up to about 1100 K;

(b) a radio frequency multipole assembly having a plurality of rods conducting radio frequency current and positioned parallel with and surrounding said ion guide axis for guiding ions through said collision cell; and (c) multipole rod heater means for maintaining said plurality of rods at a second elevated temperature slightly higher than said first elevated temperature.

12. The apparatus of claim 11 wherein said multipole assembly comprises eight rods surrounding said ion guide axis.

13. The apparatus of claim 12 wherein said plurality of rods contain twin current bearing heater wires extending along the lengths of said rods for maintaining said rods at said second elevated temperature while minimizing magnetic fields generated by heater wire current.

14. The apparatus of claim 13 wherein said plurality of rods are hollow and contain packing material therein surrounding said heater wires, to electrically isolate said wires from outer portions of said rods.

15. The apparatus of claim 13 further including means for providing absorption measurements of vapors exhibiting strong optical transitions by projecting light beams along said ion guide axis.

16. The apparatus of claim 12 further including means for providing absorption measurements of vapors exhibiting strong optical transitions by projecting light beams along said ion guide axis.

17. The apparatus of claim 11 wherein said plurality of rods contain twin current bearing heater wires extending along the lengths of said rods for maintaining said rods at said second elevated temperature while minimizing magnetic fields generated by heater wire current.

18. The apparatus of claim 17 wherein said plurality of rods are hollow and contain packing material therein surrounding said heater wires, to electrically isolate said wires from outer portions of said rods.

19. The apparatus of claim 18 further including means for providing absorption measurements of vapors exhibiting strong optical transitions by projecting light beams along said ion guide axis.

20. The apparatus of claim 11 further including means for providing absorption measurements of vapors exhibiting strong optical transitions by projecting light beams along said ion guide axis.

* * * * *